US007575362B1

(12) United States Patent
Hsu

(10) Patent No.: US 7,575,362 B1
(45) Date of Patent: Aug. 18, 2009

(54) STAND STRUCTURE OF AN LED CHRISTMAS LAMP

(76) Inventor: Fu-Hsien Hsu, 2F-1, No. 152, Nan Ya Street, Hsinchu City (TW)

( * ) Notice: Subject to any disclaimer, the term of this patent is extended or adjusted under 35 U.S.C. 154(b) by 0 days.

(21) Appl. No.: 12/078,818

(22) Filed: Apr. 7, 2008

(51) Int. Cl.
*H01R 33/00* (2006.01)

(52) U.S. Cl. ..... 362/654; 362/653; 362/652; 362/647; 439/699.2

(58) Field of Classification Search ..... 362/647, 362/653, 654, 655, 800, 806; 439/699.1, 439/699.2, 654, 655, 619
See application file for complete search history.

(56) References Cited

U.S. PATENT DOCUMENTS 4,999,751 A * 3/1991 Chen ..... 362/654
6,120,312 A * 9/2000 Shu ..... 439/356
6,123,433 A * 9/2000 Chen ..... 362/654
6,361,368 B1 * 3/2002 Tseng ..... 439/619
7,422,489 B1 * 9/2008 Tseng ..... 439/699.2

* cited by examiner

*Primary Examiner*—Thomas M Sember
(74) *Attorney, Agent, or Firm*—Rosenberg, Klein & Lee

(57) ABSTRACT

An LED Christmas lamp has the lamp stand composed of a main stand, a supporting stand and a conductive lead stand. A positioning protruding surface with a long concave groove is formed in the front side of the containing groove space, and a protruding bar is formed in the relative rear side of the containing groove space. A smaller compartment groove stand is extended in the bottom of the conductive lead stand. An arc shaped protruding groove surface is formed on the joint surface of the compartment stand and containing groove. A lamp laying groove space with protruding stop surfaces in its front and rear sides are formed inside the supporting stand. A positioning cutting surface with a long protruding bar is formed in the front side of the supporting stand and a concave groove is set in the rear side. Then, they are laid in the main stand to let the two pins of LED to be stick with the conductive copper plates of the two power conductive leads smoothly.

3 Claims, 15 Drawing Sheets

STAND STRUCTURE OF AN LED CHRISTMAS LAMP

FIELD OF THE INVENTION

The present invention is related to an improved technology about Christmas lamp products, and especially is in accordance with an improved technology designed for the lamp stand structure of a kind of LED typed Christmas lamp.

BACKGROUND OF THE INVENTION

The current known LED typed Christmas lamp stands generally have two kinds of patterns as shown in FIG. 1 (U.S. Pat. No. 6,120,312) and FIG. 3 (U.S. Pat. No. 6,183,310). Please refer to the first kind of known lamp structure shown in FIGS. 1 and 2, which is a lamp stand without soft core. The structure mainly integrates an LED 40 with a lampshade 90 directly, and cooperates with a lamp stand 70 composed of an internal seat 71 and an external seat 72. Two sides of the said internal seat 71 are set with a wire bestowing groove 711, which is able to lay two power conducting leads 50, and set with chasms 712 at two sides of the groove for clipping of conductive copper plates 51. Cylindrical supporting portions 511 are formed at the upper portions of the said conductive copper plates 51. Please refer to those shown in FIG. 2. The internal seat 71 assembled with power conducting leads 50 is put in the external seat 72 first, and the lampshade 90 equipped with LED 40 are put in the external seat 72 from the top right after. And, two connecting pins 41 of the LED 40 are separately inserted in the supporting portions 511 of the conductive copper plates 51 and nestled against with each other to conduct the power to the LED 40 thus complete the assembly of the whole group of a lamp stand of the LED typed Christmas lamp. However, there is deficiency existed in this practical application. It mainly is due to that the corresponding precision is required while two linear wired pins 41 of the LED 40 are inserted in the supporting portions 511 of conductive copper plates. It occurred often in operations that the connecting pins 41 are withstood against the upper edge of the supporting portions 511 of conductive copper plates 51 because of minor negligence and are unable to be inserted in smoothly. This is merely increasing the operation time, and even the assembly is unable to be accomplished then the manufacturing cost is wasted.

Please refer to another known lamp stand structure shown in FIGS. 3 and 4, which is also a lamp stand design without soft core. The structure also integrates an LED 40 with a lampshade 90 directly, and cooperates with a lamp stand 80 composed of an internal seat 81 and an external seat 82. Two sides of the said internal seat 81 are set with a wire bestowing groove 811 which is able to lay two power conducting leads 50. The different point is that a winding plug 812 is formed on top of the wire-bestowing groove 811, and a joint groove hole 813 is set on top of the winding plug 812. Two power conductive leads 50 are not set with conductive copper plates but remove a proper length of insulating body in the leads' ends to expose the metal wires 52. These metal wires 52 are firstly wound on top of the winding plug 812 then penetrate and put in the joint groove holes 813 with their ends folded and wound outside of the holes. After accomplishing the assembly of power conductive leads 50 and the internal seat 81, they are put in the external seat 82 first then the lampshade 90 equipped with LED 40 are put in the external seat 82 from the top right after. And, two connecting pins 41 of the LED 40 are separately inserted in the joint groove holes 813 set with conductive wires 52 and nestled against with the conductive wires 52 to conduct the power to the LED 40 thus complete the assembly of the whole group of a lamp stand of the LED typed Christmas lamp. However, there is the same deficiency existed in this practical application as the aforementioned known lamp stand. That is, the corresponding precision is required while two linear wired pins 41 of the LED 40 are inserted in tow joint groove holes 813 set with conductive wires 52. Otherwise, the connecting pins 41 are withstood against the upper edge of the joint groove holes 813 set with conductive wires 52 easily and are unable to be inserted in smoothly. This is merely increasing the operation time, and even the assembly is unable to be accomplished then the manufacturing cost is wasted.

SUMMARY OF THE INVENTION

It is therefore a primary object of the invention to provide an improved technology about Christmas lamp products, and especially in accordance with an improved technology designed for the lamp stand structure of a kind of LED typed Christmas lamp. Now, accompanying with the following drawings, the character of the present invention will be described here and after.

DETAILED DESCRIPTION OF THE PREFERRED EMBODIMENT

Figure 1:
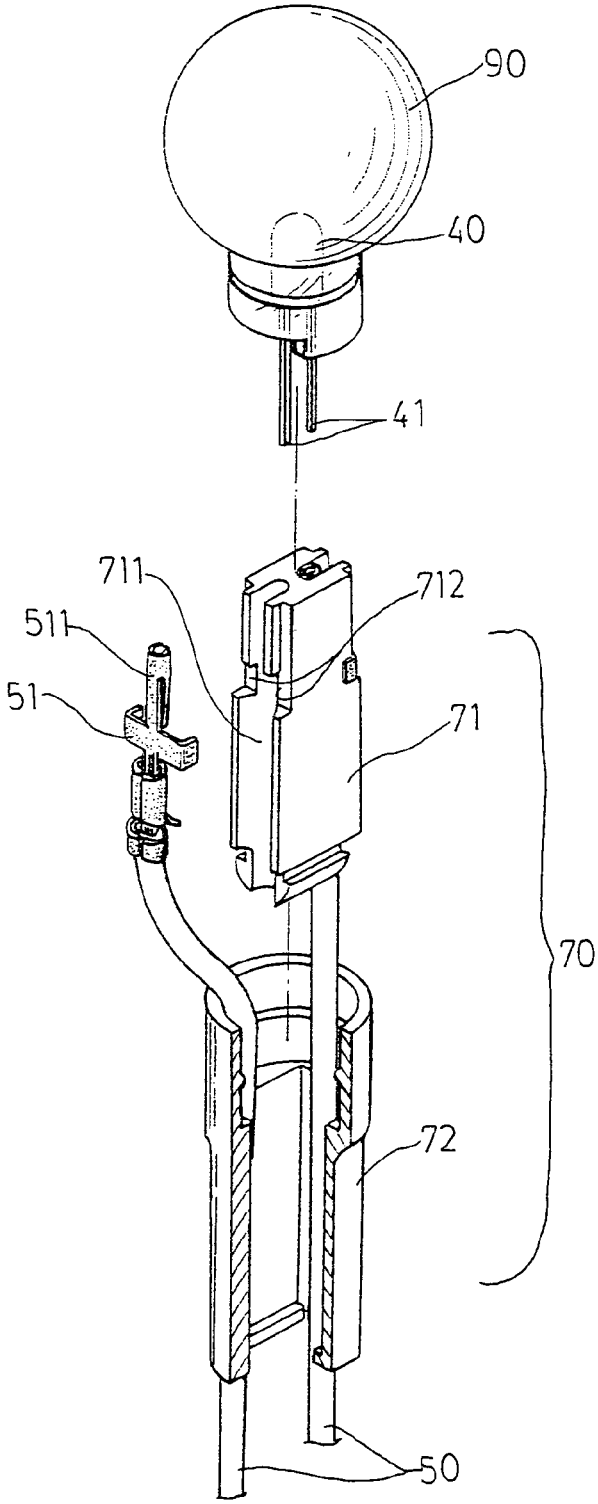
F I G. 1 (prior art)
FIG. 1 is an analytic diagram of a known structure of the lamp stand.
Figure 2:
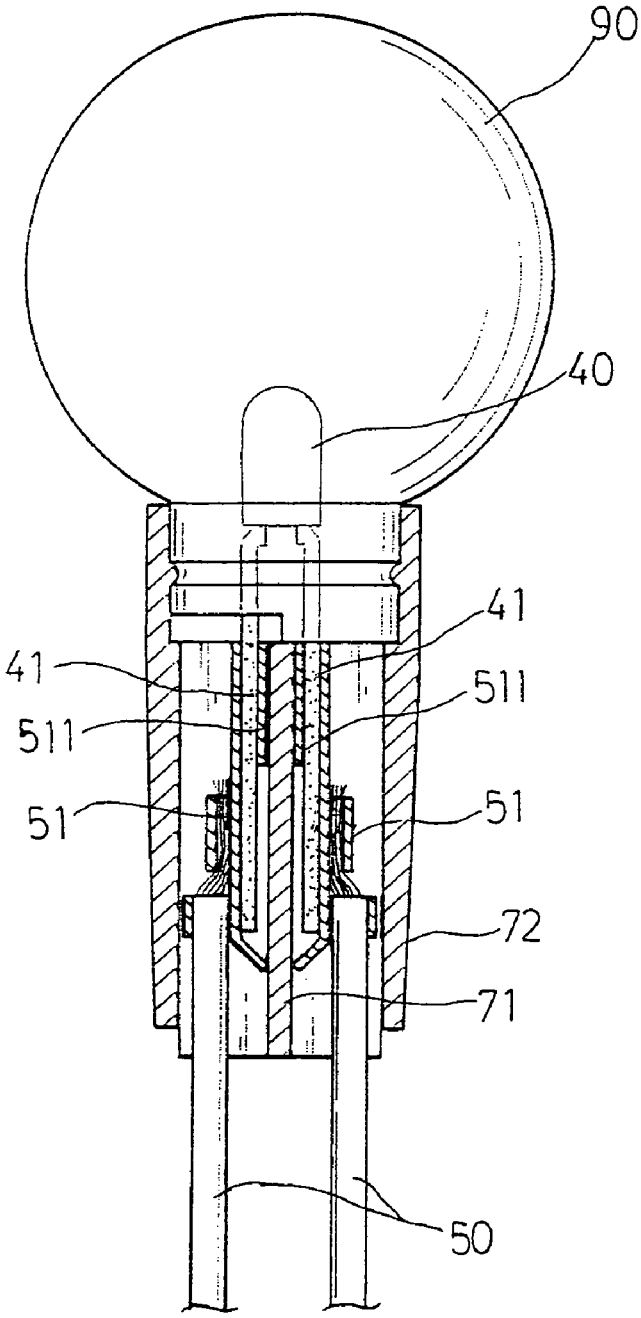
F I G. 2 (prior art)
FIG. 2 is a sectional diagram of FIG. 1.
Figure 3:
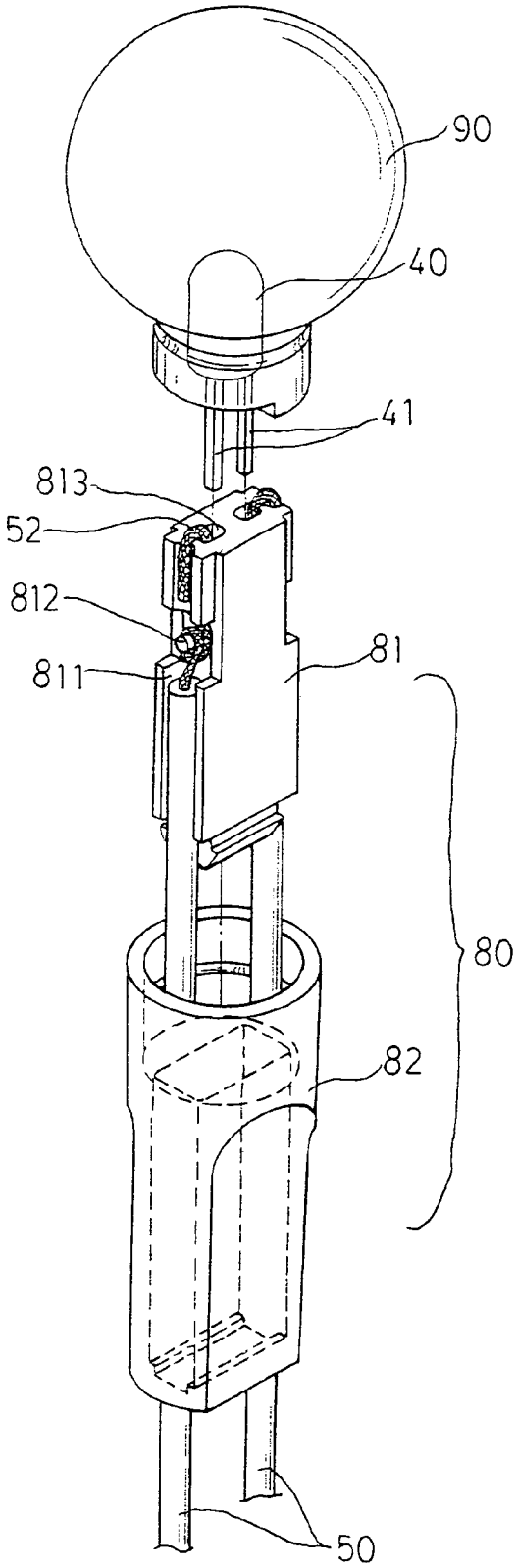
F I G. 3 (prior art)
FIG. 3 is an analytic diagram of another known structure of the lamp stand.
Figure 4:
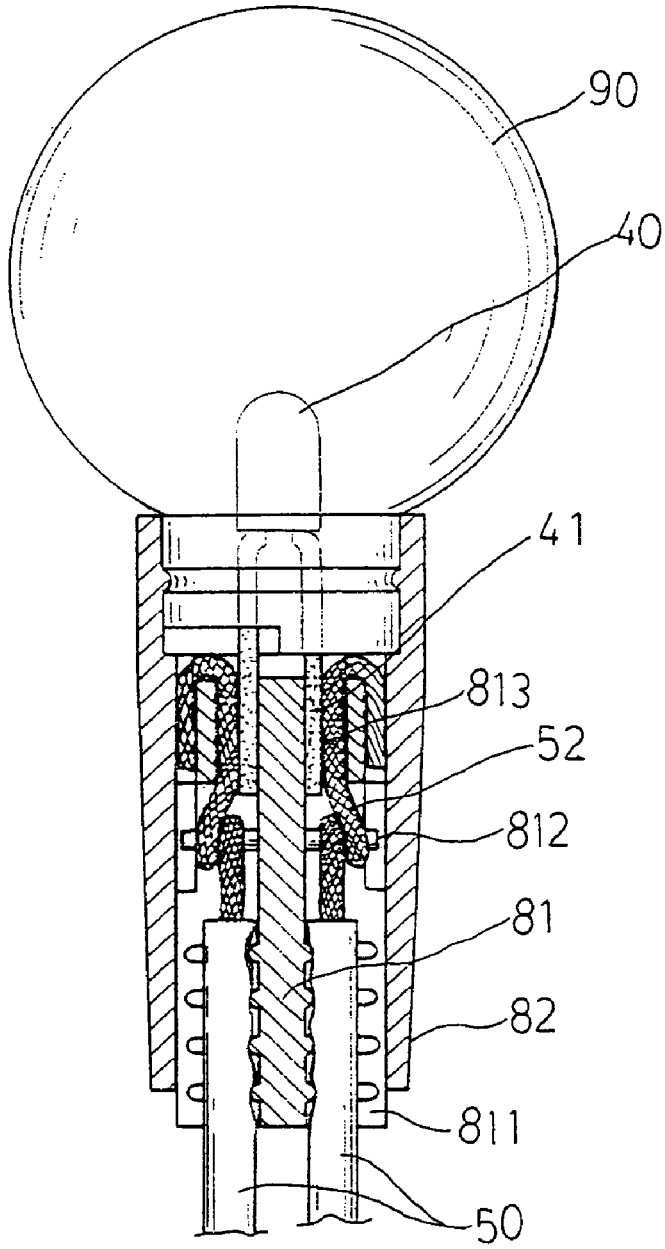
FIG. 4 (prior art)
FIG. 4 is a sectional diagram of FIG. 3.
Figure 5:
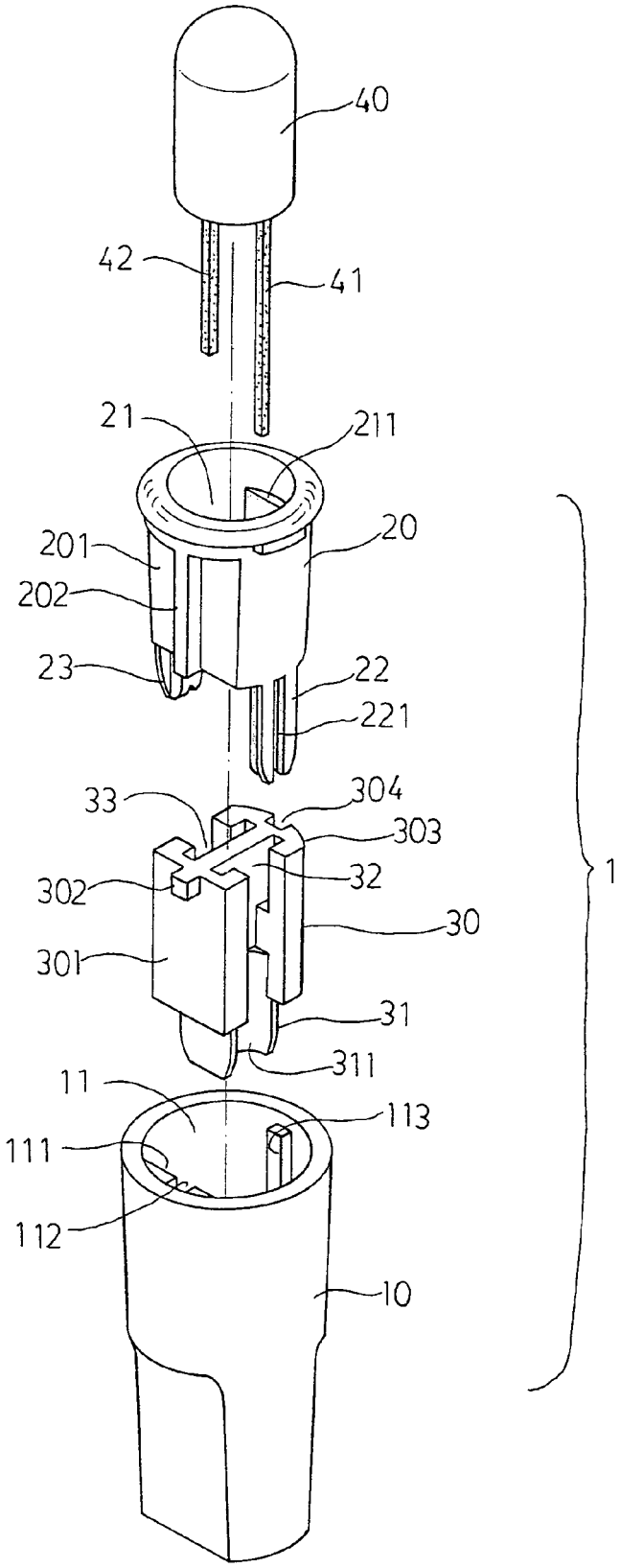
FIGS. 5 and 6 are analytic diagrams of lamp stands of the present invention.
Figure 6:
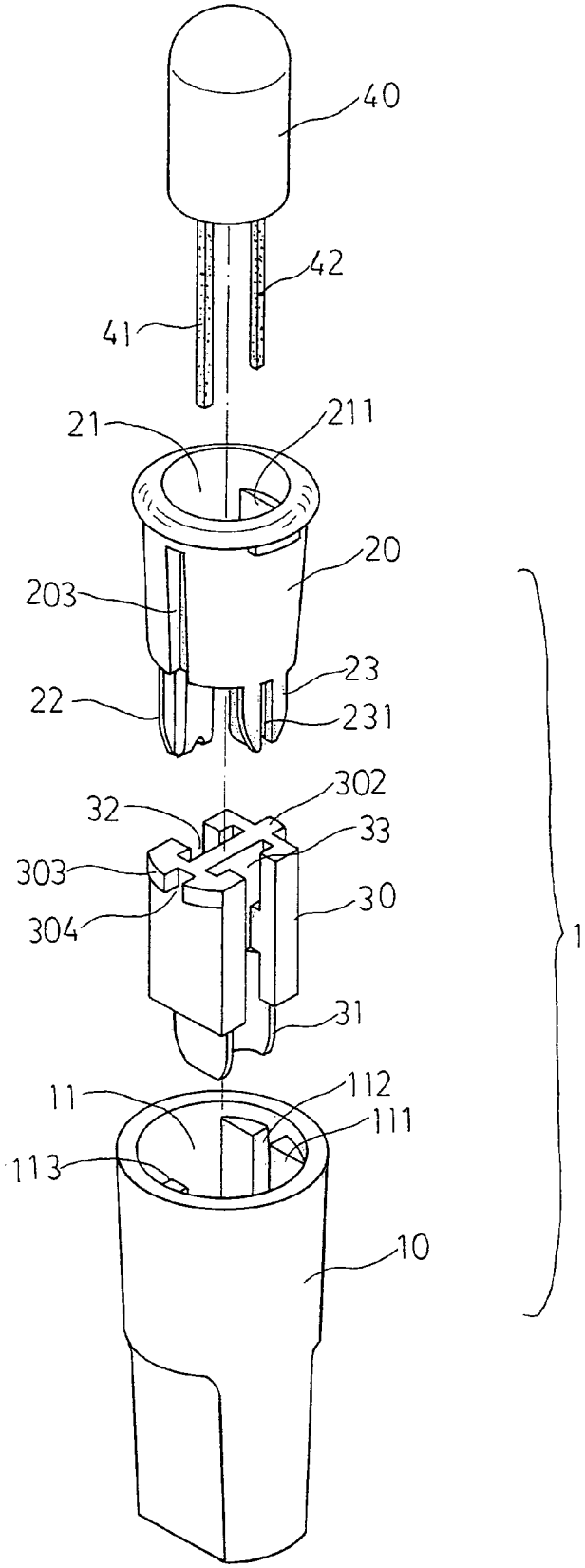

Please refer to those shown in FIGS. 5 and 6. The lamp stand 1 of the present invention is composed of a main stand 10, a supporting stand 20, and a conductive lead stand 30. A shallow containing groove space 11 is formed in the said main stand 10. A positioning protruding surface 111 equipped with the long concave groove 112 is formed in the front side of the shallow containing groove space 11, and a protruding bar 113 is formed in the relative rear side of the shallow containing groove space 11. A compartment groove stand 31 is extended in the bottom of the conductive lead stand 30, whose left and right faces each form with a bar typed opening and form inward separate T typed containing grooves 32, 33. Furthermore, a positioning cutting surface 301 with a protruding bar 302 on top is formed in the front side of the conductive lead stand 30, and an arc shaped protruding positioning edge 303 with a concave groove 304 in the middle is formed on the upper edge of the rear side surface. And each arc shaped positioning groove surface 311 is formed on the right and left surfaces of the compartment stand 31 and linked with containing grooves 32, 33 separately. A lamp laying groove space 21 with its top opened is formed inside the supporting stand 20, and each protruding stop surface 211 is formed in the front and rear sides of the laying groove space 21. One long and one short supporting bar plates 22, 23 are formed in the left and right sides of a bottom of the lamp laying groove space. Furthermore, a positioning cutting surface 201 with a long protruding bar 202 is formed in the front side and a concave groove 203 is set in the rear side surface. And, two separate concaved grooves 221, 231 are formed in the middle of outside surfaces of the two supporting bar plates 22, 23.

Figure 7:
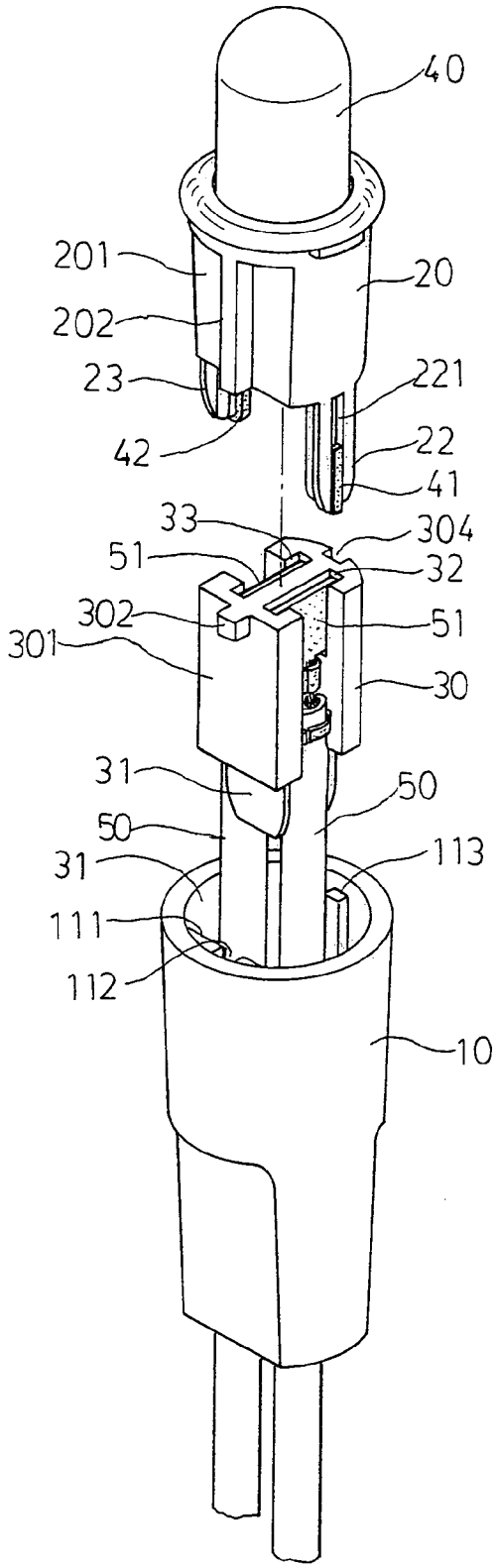
FIGS. 7 and 8 are assembly diagrams of lamp stands of the present invention.
Figure 8:
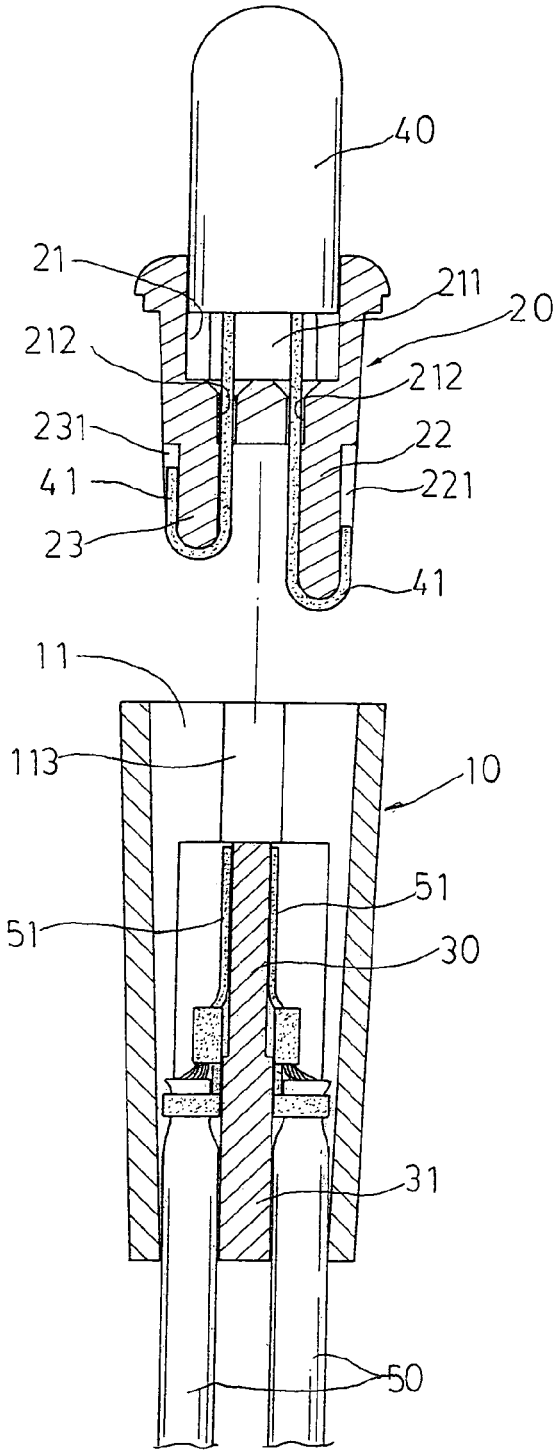
Figure 9:
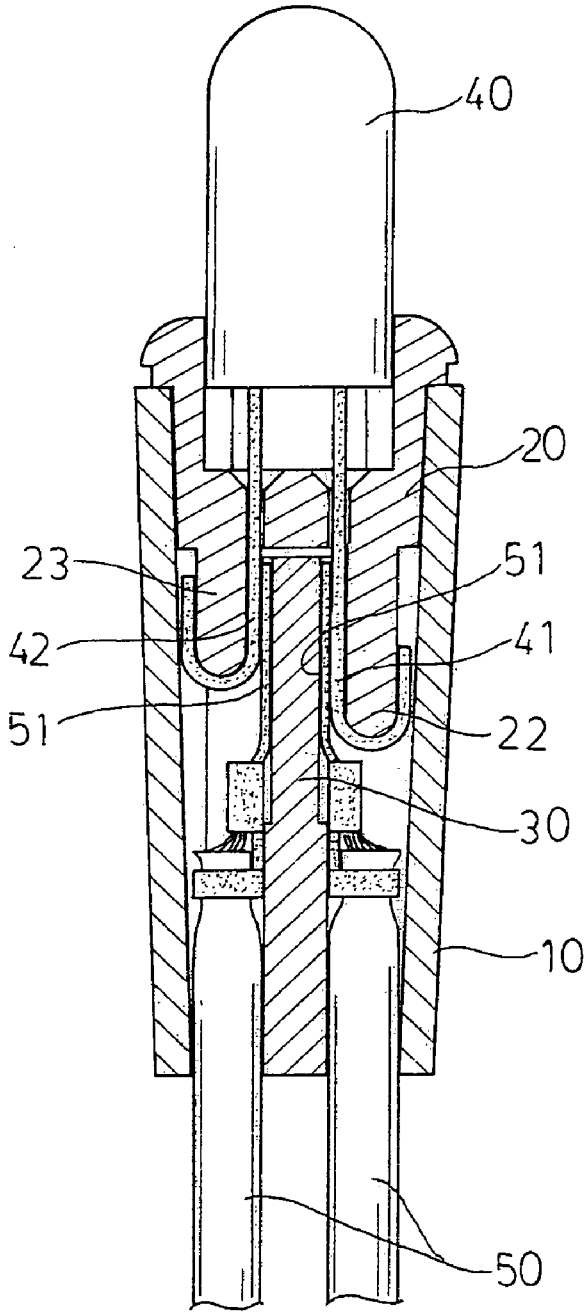
FIG. 9 is an assembly diagram of a lamp stand of the present invention.
Figure 10:
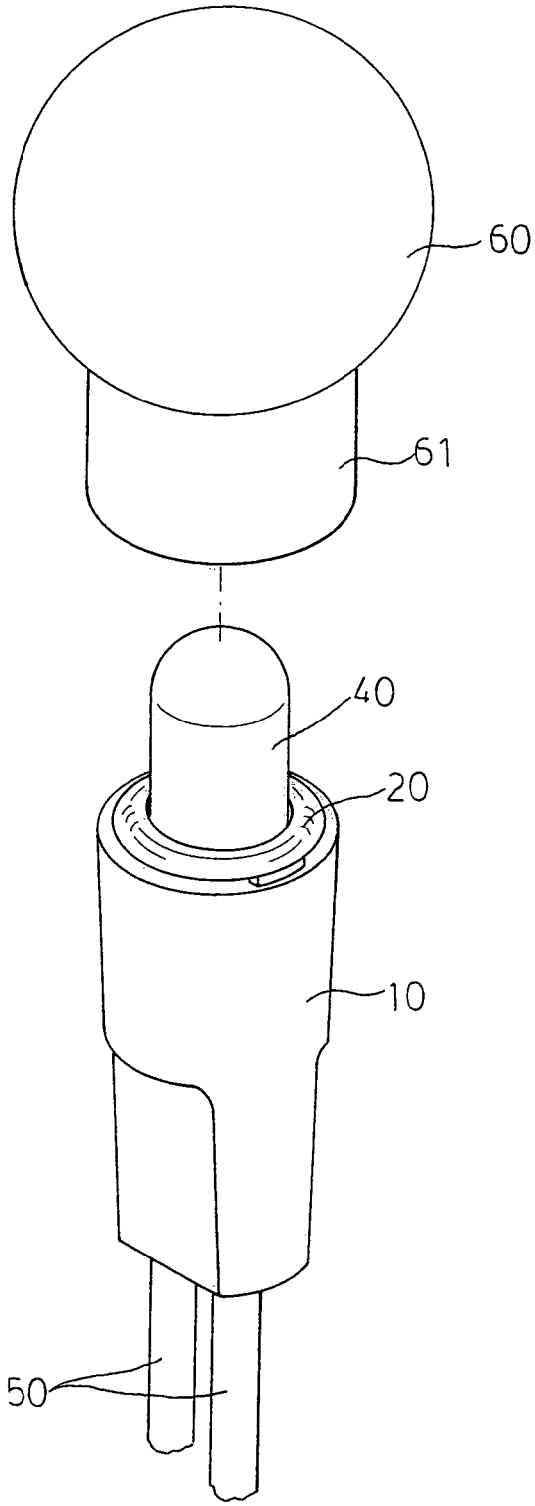
FIGS. 10 and 11 are assembly diagrams of lamp stands collocated with lampshades of the present invention.
Figure 11:
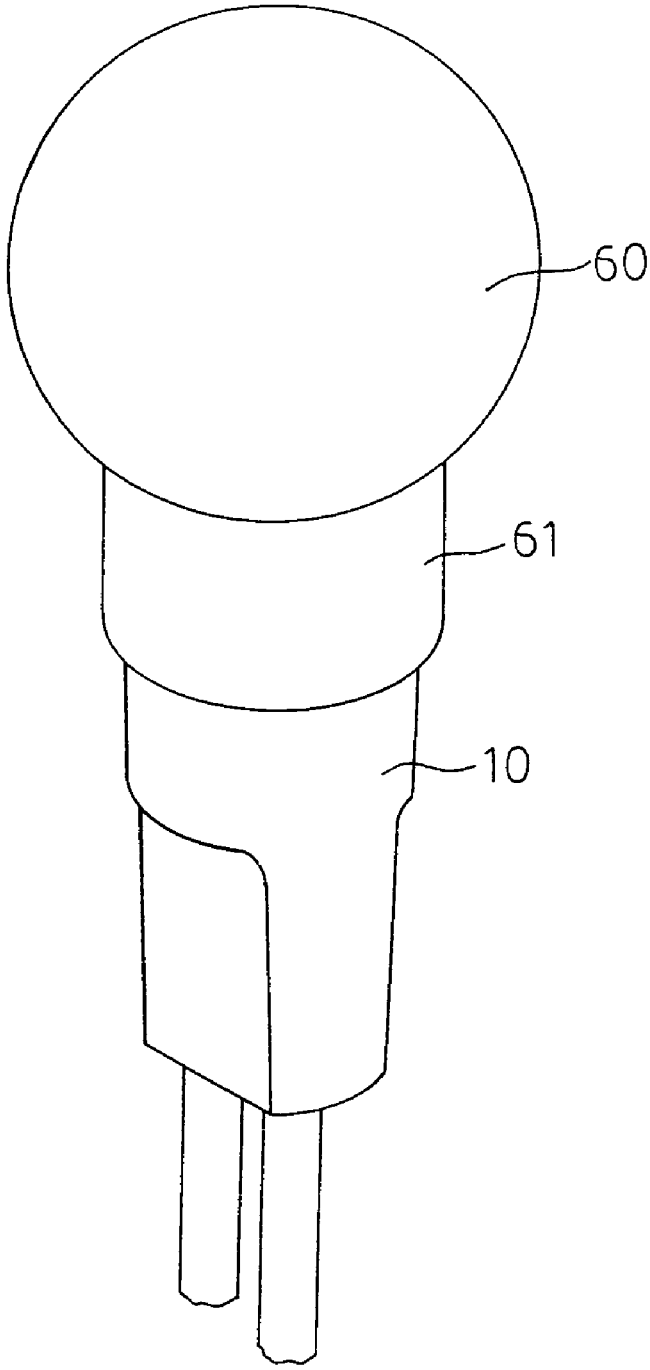

Please refer to those shown in FIGS. 7, 8 and 9. The base of an LED 40 is set with a plus pole and a minus pole that can be distinguished by a long connecting pin 41 and a short connecting pin 42. While the LED is put in the lamp laying groove space 21 of the supporting stand 20, the base of LED 40 is topped against by the protruding stop surface 211 with LED's connecting pins 41, 42 passing through the through hole 213. The long connecting pin 41 is leaned against the long supporting bar plate 22 along its inner side, and the short connecting pin 42 is leaned against the short supporting bar plate 23 along its inner side. And, both connecting pins are bent outward then separately put inside the concave groove 221, 231. Further, the two power conductive leads 50 are passing through a main stand 10 from the base, and are separately put on the arc shaped groove surface 311 of the compartment stand 31 in the conductive lead stand. Their conductive copper plates 51 are separately put in the T shaped containing groove 32, 33 then put in the bottom of the main stand 10 along with the conductive lead stand 30 immediately. And the positioning cutting surface 301 with protruding bar 302 is set in the conductive lead stand 30 and must face toward to the positioning protruding surface 111 with concaved groove 112 in the main stand 10. The positioning protruding edge 303 with concaved groove 304 must have the same direction with protruding bar 113 set in the containing groove space 11 of the main stand. With this kind of set up can prevent the miss-laid of the plus and minus poles of the power conductive leads. Then, the supporting stand 20 jointed with the LED 40 is put in the containing groove space 11 of the main stand 10 to let the two supporting bar plates 22, 23 separately be put in the bar shaped openings on left and right sides of the conductive lead stand 30 then let the two connecting pins 41, 42 of the LED 40 to be separately nestled closely against two conductive copper plates 51 of the power conductive leads. And, this kind of joint is an internal nestling style to assure and increase their contacting surface of the joint. Also, due to the arc shaped bending surfaces of these two connecting pins 41, 42, the smooth insertion can be achieved without the occurrence of clip against with the conductive copper plates 51. Further, it is the same to face the positioning cutting surface 201 set with protruding bar 202 in the said conductive lead stand 30 toward the positioning protruding surface 111 with the concaved groove 112 in the main stand 10. And, its one surface set with the concaved groove 203 must have the same direction with the surface set with the protruding bar 113 in the containing groove space 11 of the main stand to assure the insertion in the main stand 10. By this way, the miss-insertion of the plus and minus poles of the LED 40 can be avoided. Please refer to those shown in FIGS. 10 and 11. The assembled lamp stand 1 can be collocated with a lampshade 60. The sleeve fit portion of 61 in the lampshade 60 can be utilized to be sleeve-inserted directly on the main stand 10 to form an LED Christmas lamp stand with the lampshade.

Figure 12:
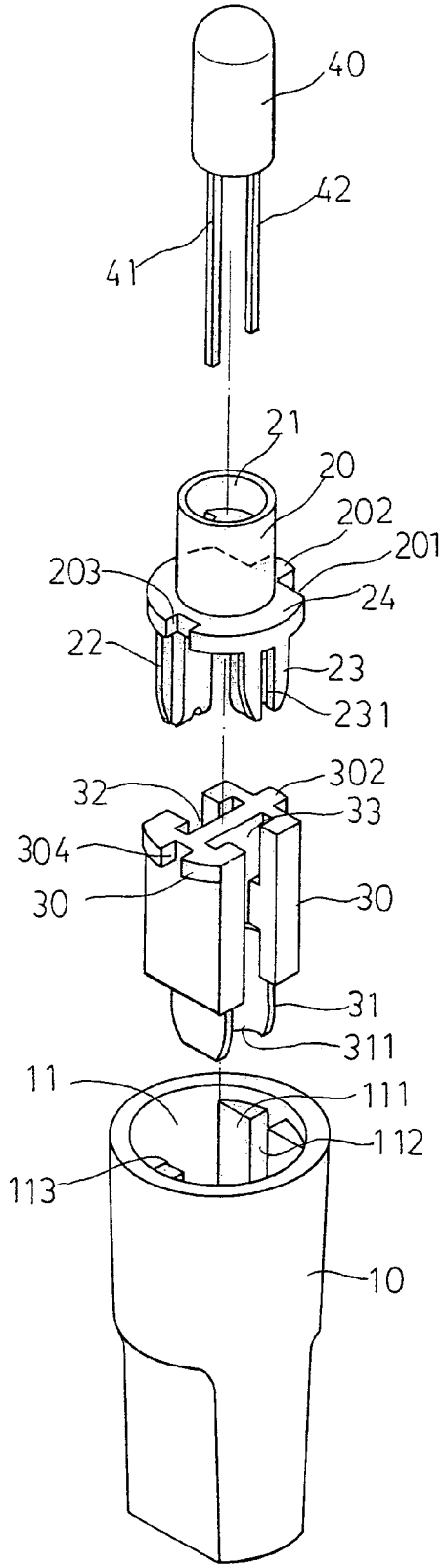
FIGS. 12 and 13 are structural analytic diagrams of lamp stands in another embodiment of the present invention.
Figure 13:
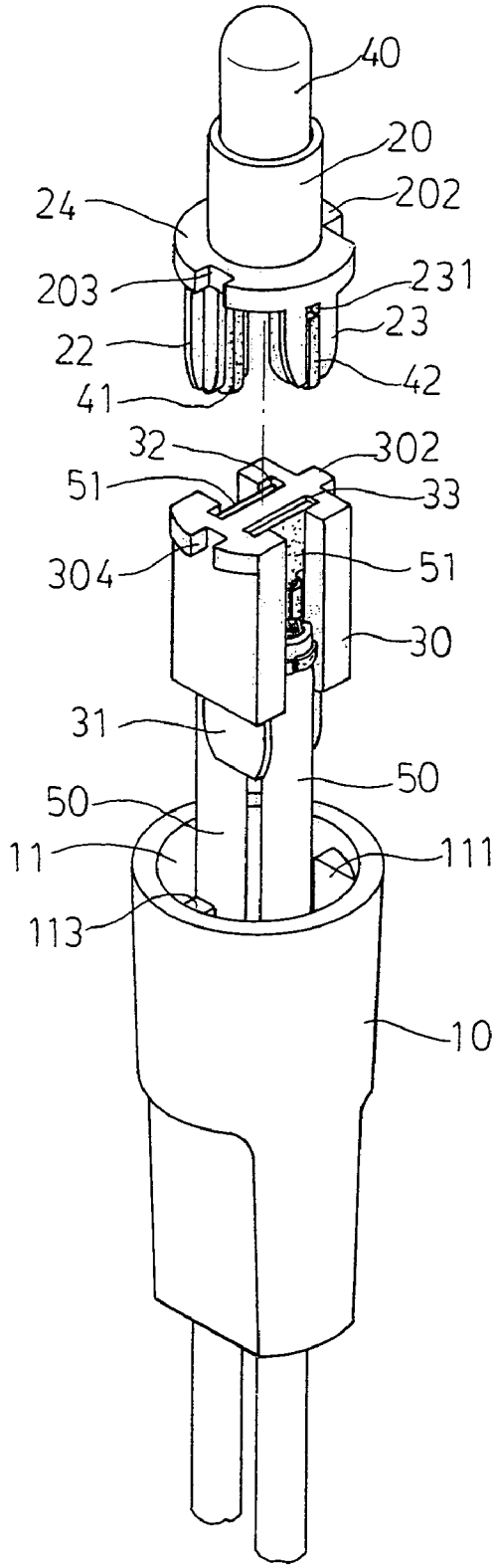
Figure 14:
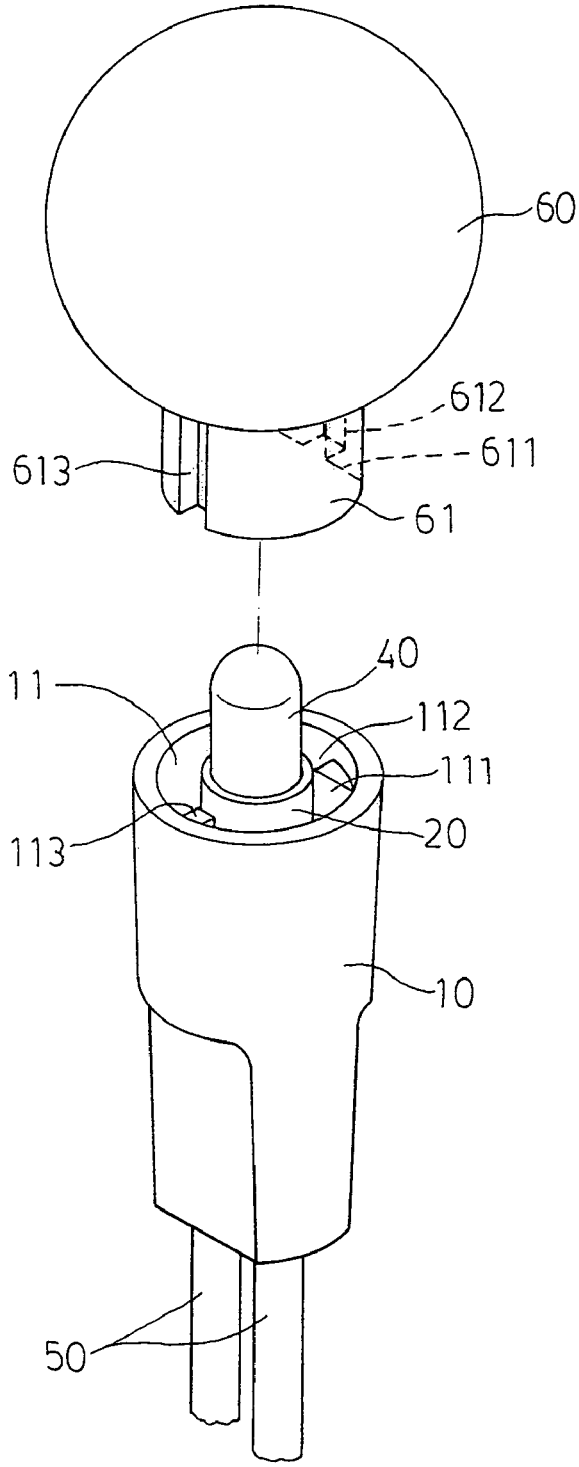
FIGS. 14 and 15 are assembly diagrams of lamp stands collocated with lampshades in another embodiment of the present invention.
Figure 15:
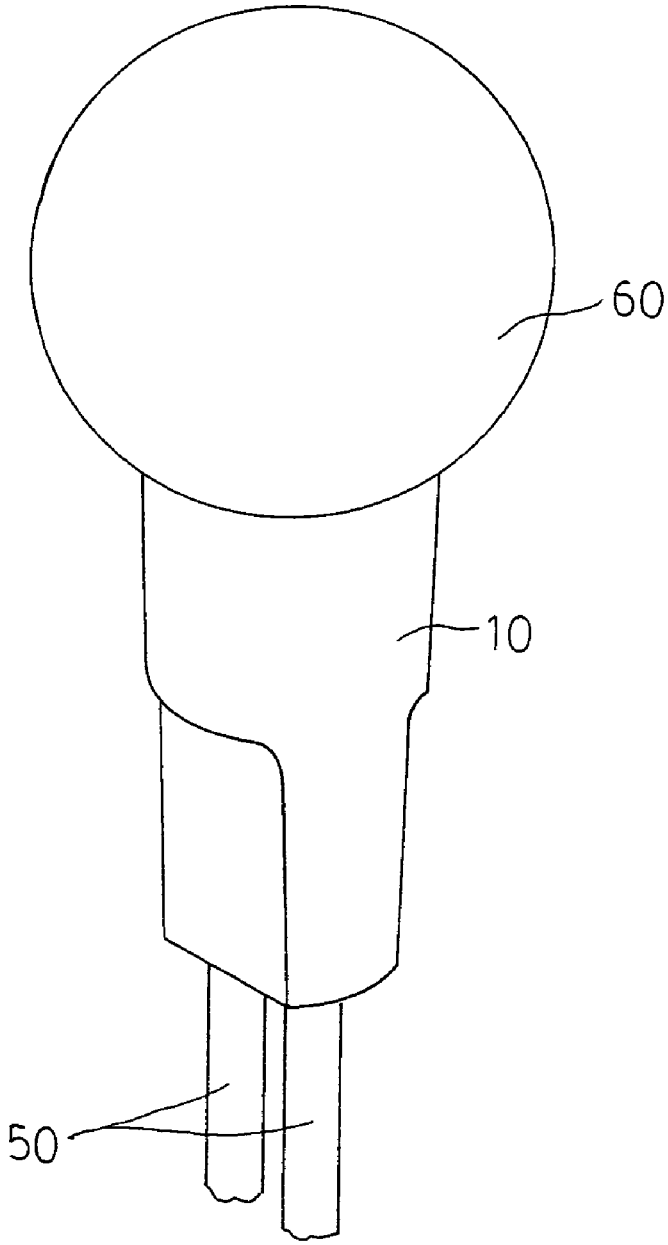

Please refer to those shown in FIGS. 12 and 13 that are the structural patterns of another embodiment of the present invention. It is mainly designed for smaller sized LED. The said lamp is also composed of a main stand 10, a supporting stand 20, and a conductive lead stand 30. The structural patterns of the main stand 10 and the conductive lead stand 30 are exact the same with the aforementioned. Only the supporting stand 20 has slightly changed that is mainly design for a cylindrical body with its outer diameter slightly larger than the inner diameter of the LED 40. The inside of the stand body is still a lamp laying compartment space with a circular disc base plate 24 formed in the bottom and with larger diameter. One side of the base plate 24 relative to the protruding surface 111 in the containing groove space 11 of the main stand 10 is also cut-set with the positioning cutting surface 201 with protruding bar 202 formed in the middle, and the other one side relative to the protruding bar 113 in the containing groove space 11 of the main stand 10 is also set with a concaved groove 203 in the middle. One long and one short supporting bar plates 22, 23 each with a long concave groove 221, 231 formed in the middle of outside surface are formed in the left and right sides of the bottom. A supporting stand 20 is utilized to joint with the LED 40 to let LED's two connecting pins 41, 42 bent separately and lean against the supporting bar plates 22, 23, and the power conductive leads 50 are also connected with the conductive lead stand 30 then put in the main stand 10. The supporting stand 20 jointed with LED is then laid in the main stand 10 immediately to be connect with the conductive lead stand 30 to conduct the LED 40 with the power conductive lead 50. Please refer again to those shown in FIGS. 14 and 15. The lamp stand 1 after assembly can also be collocated a lampshade 60. The outer diameter of the sleeve fit portion 61 in the bottom of the lampshade 60 is equal to the inner diameter of the containing groove space 11 of the main stand 10. And, a positioning cutting surface 611 with a protruding bar 612 formed in its middle is cut-set in one relative side of the containing groove space 11 set with the positioning protruding surface 111 having the concaved groove 112. And, a bar shaped concaved groove 613 is formed on one relative side of the containing groove space 11 set with protruding bar 113. By this way, the sleeve fit portion 61 can be inserted in the containing groove space 11 to joint the lampshade 60 and the lamp stand 1.

I claim:

1. A stand structure of an LED Christmas lamp comprising:

a main stand having a shallow containing groove space formed therein;

a supporting stand having a lamp laying groove space having an open upper end, the supporting stand having a pair of supporting bar plates extending from a bottom thereof on opposing sides of the supporting stand, one of the pair of supporting bar plates being longer than the other of the pair of supporting bar plates, each supporting bar plate having a centrally disposed elongated concave groove formed in an outer surface thereof; and a conductive lead stand having a bottom extended with a compartment groove stand, the conductive lead stand having opposing faces respectively having a bar shaped opening and a T-shaped containing groove formed therein, each T-shaped containing groove being disposed adjacent an upper end of the conductive lead stand;

wherein two power conductive leads each having a conductive copper plate coupled to an end thereof are able to respectively lean on corresponding seats of the compartment grooves of the conductive lead stand, the conductive copper plates being received inside the T-shaped containing grooves and the conductive lead stand being disposed in the shallow containing groove space of the main stand, and an LED having a pair of pins being inserted in the supporting stand with each of the pins being bent in an arcuate shape and respectively received in the concave grooves of the supporting bar plates, the supporting stand containing the LED being disposed in the main stand, the arcuate shape of the two pins of the LED respectively make electrical contact with the conductive copper plates of the two power conductive leads.

2. The stand structure of an LED Christmas lamp as claimed in claim 1, wherein a positioning protruding surface with a long concave groove is formed in a front side of the containing groove space, and a protruding bar is formed in a rear side, and a positioning cutting surface with a protruding bar on top is formed in a front side of the conductive lead stand, and an arc shaped protruding positioning edge with a concave groove in a middle is formed on an upper edge of a rear side surface; each arc shaped positioning groove surface is formed on opposing side surfaces of the compartment stand and linked with corresponding containing grooves, and a positioning cutting surface with a long protruding bar is formed in a front side of the supporting stand, a concave groove is disposed on a rear side surface, and each protruding stop surface is formed in front and rear sides of the laying groove space.

3. The stand structure of an LED Christmas lamp as claimed in claim 1, wherein the supporting stand has a cylindrical stand body with an inner diameter being slightly larger than an outside diameter thereof, an inside of the stand body being a lamp laying compartment space with a circular disc base plate formed in a bottom and with a larger diameter, one long and one short supporting bar plate each with an elongated concave groove formed in a middle of an outside surface thereof, the supporting bar plates being formed in the sides of a bottom in a base plate, and a positioning cutting surface with a protruding bar in a middle also being formed in one side of the protruding surface in the base plate of the supporting stand in correspondence to a long concave groove of a positioning protruding surface formed in the containing groove of the main stand, and the base plate having a concave groove being in a side thereof in correspondence to the protruding bar in the containing groove space.

* * * * *